United States Patent [19]

Grosjean

[11] Patent Number: 4,537,024

[45] Date of Patent: Aug. 27, 1985

[54] TURBINE ENGINES

[75] Inventor: William C. Grosjean, Poway, Calif.

[73] Assignee: Solar Turbines, Incorporated, San Diego, Calif.

[21] Appl. No.: 418,019

[22] Filed: Sep. 14, 1982

Related U.S. Application Data

[63] Continuation of Ser. No. 32,485, Apr. 23, 1979, abandoned, which is a continuation of Ser. No. 862,279, Dec. 19, 1977, abandoned.

[51] Int. Cl.[3] ..... F02C 7/28

[52] U.S. Cl. ..... 60/39.161; 415/139

[58] Field of Search ..... 415/134, 138, 139, 172 R, 415/173 R, 178; 60/39.161

[56] References Cited

U.S. PATENT DOCUMENTS

| | | | |
|---|---|---|---|
| 2,893,576 | 2/1959 | Lombard | 60/39.161 |
| 2,997,275 | 8/1961 | Bean et al. | 415/139 |
| 3,542,483 | 11/1970 | Gagliardi | 415/139 |
| 3,728,041 | 4/1973 | Bertelson | 415/139 |
| 3,752,598 | 8/1973 | Bowers et al. | 415/139 |
| 3,892,497 | 7/1975 | Gunderlock et al. | 415/139 |
| 3,970,318 | 7/1976 | Tuley | 415/139 |
| 3,975,114 | 8/1976 | Kalkbrennen | 415/138 |
| 3,986,789 | 10/1976 | Pask | 415/178 |
| 4,013,376 | 3/1977 | Bisson et al. | 415/139 |

*Primary Examiner*—Louis J. Casaregola

*Attorney, Agent, or Firm*—LeBlanc, Nolan, Shur & Nies

[57] ABSTRACT

Segmented nozzles and tip shoes having improved seals for keeping hot gases from leaking through the gaps between adjacent segments. The seals have an interference fit with grooves in the opposite ends of adjacent segments and span the gaps between those segments. The seals are sufficiently flexible to fit non-parallel grooves, and they may have a concave cross-section which prevents binding and seal distortion in such circumstances.

18 Claims, 9 Drawing Figures

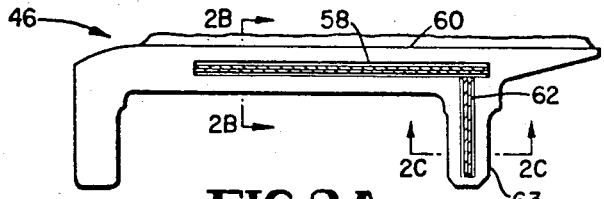
FIG. 2A
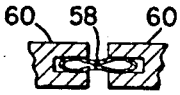
FIG. 2B
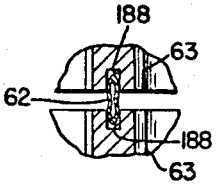
FIG. 2C
FIG. 2
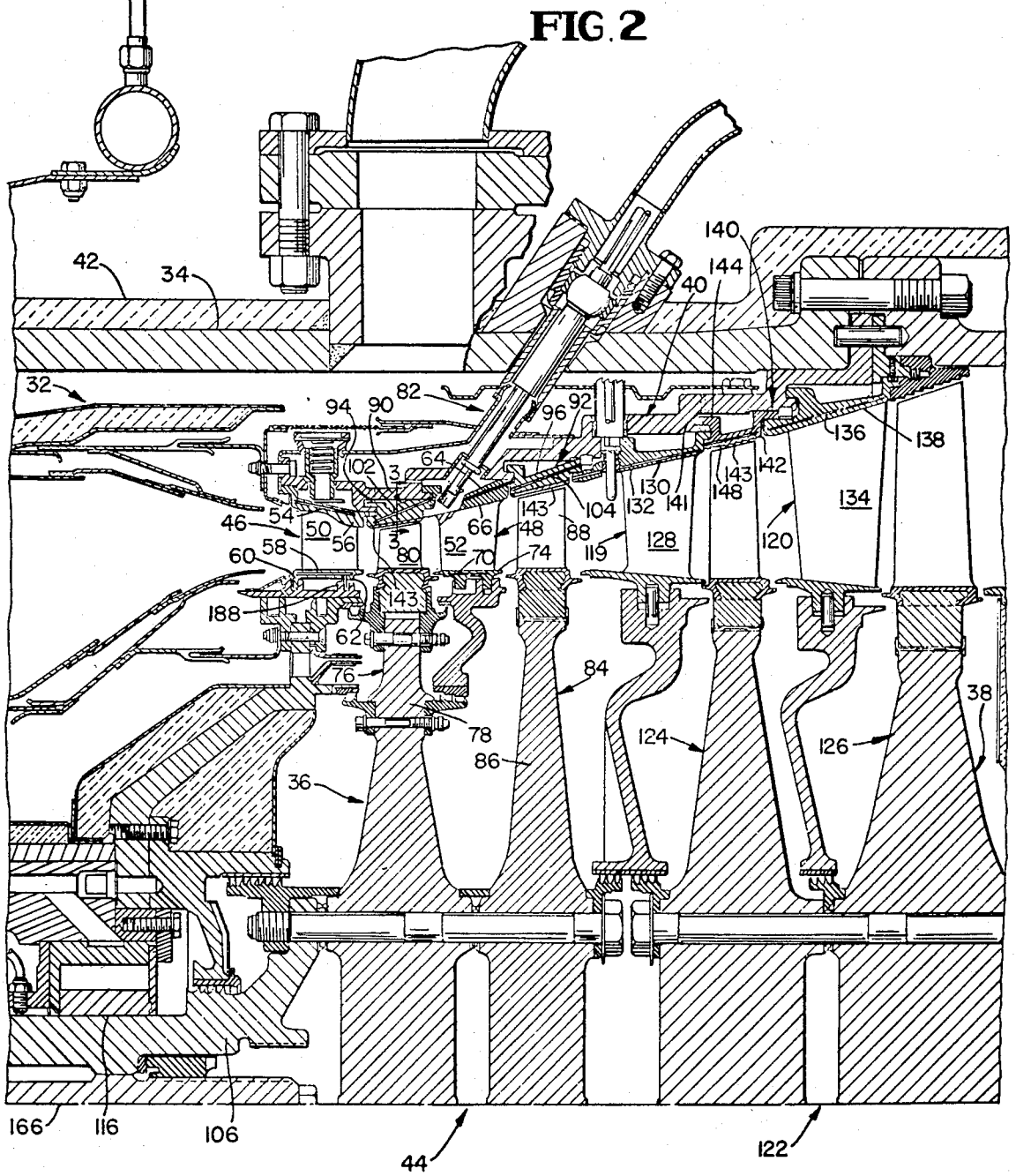

TURBINE ENGINES

This application is a continuation of application Ser. No. 32,485 filed Apr. 23, 1979 (now abandoned). The latter is a continuation of application Ser. No. 862,279 filed Dec. 19, 1977 (now abandoned).

The present invention relates to turbine engines, and, more particularly, to turbine engines having turbines with segmented nozzles and tip shoes and novel, improved seals for keeping gases from escaping through the gaps between adjacent segments.

A gas turbine engine typically includes a compressor, a combustor for increasing the temperature of the compressor discharge air, a gas producer turbine through which gases exiting from the combustor are expanded to drive the compressor, and a power turbine through which the gases are further expanded to produce useful energy. In industrial applications this energy is employed to power a gas line booster compressor, an electrical generator, or a mechanical drive unit, for example.

The turbines may have one or more stages. Each stage is typically composed of a stationary nozzle ring and a rotating disc or wheel with radially extending blades against which the gases impinge as they exit from the nozzles in the stationary ring.

Because the turbine disc reaches an elevated temperature during operation, a considerable clearance must be left between the blade tips and the casing or shroud in which it is housed to accommodate differential expansion between the rotating and stationary components of the machine.

If sufficient clearance to accommodate thermal expansion is provided, however, the gases can be pumped past the tips of the rotor blades in significant quantities, substantially reducing the efficiency of the turbine.

It is conventional to prevent pumping of the gases past the blade tips by surrounding the disc with a stationary, ring-like tip shoe composed of a support with a layer of honeycomb or other compliant material fastened to its inner face. As the turbine blades rotate and expand, the blade tips deform the compliant tip shoe material into what is essentially a zero tolerance fit with the tips, forming a seal against the flow of gases past the blade tips.

Manufacturing and other considerations may dictate that the nozzle rings and/or tip shoes be constructed of annular segments assembled into the ringlike configuration. In these segmented constructions the radially oriented gaps between the adjacent segments must be sealed to keep the hot gases from leaking through them. As in the case of leakage past the blade tips, the escape of gases through the gaps in the nozzle ring or the tip shoe will result in reduced performance or efficiency and increased fuel consumption.

Also, hot gases leaking through the foregoing components overheats their supporting structures. This increases the turbine blade tip clearance, causing a further loss of efficiency or performance.

A number of schemes for sealing the gaps between the segments of components such as those just described have been proposed in U.S. Pat. Nos. 3,656,862 issued Apr. 18, 1972, to Rahalm et al; 3,801,220 issued Apr. 2, 1974, to Beckershoff; 3,966,356 issued June 29, 1976, to Irwin; 3,970,318 issued July 20, 1976, to Tuley; and 3,986,789 issued Oct. 19, 1976, to Pask. In general, the seals shown in those patents are flat strips bridging and fitted into grooves opening onto the apposite faces of adjacent segments as is perhaps best shown in Pask U.S. Pat. No. 3,986,789.

Seals of the type just described require impractically close tolerances in the dimensions of the segments bridged by the strips. In particular, the tolerances with which it is practical to locate the seal receiving grooves in the segments result in a fit which is too loose for an acceptable degree of sealing to be obtained. This is particularly true when the grooves are not parallel with each other due to binding and consequent distortion of the strips.

I have now invented a novel seal which is free of the foregoing disadvantages of the just-discussed conventional arrangement. In general my novel seals differ from those of the flat strip type in that they have interference fits with the grooves in which they fit. This keeps gas from leaking through the grooves around the seals even though the grooves be misaligned.

Also, the seals are made sufficiently flexible that they can warp or twist to the extent needed to readily fit into misaligned grooves.

Furthermore, the portion of the seal bridging the components associated therewith is preferably of a concave cross-sectional configuration. This minimizes binding and distortion when the seal is installed in non-parallel grooves, permitting a seal to be obtained despite the misalignment.

From the foregoing it will be apparent to the reader that one important and primary object of the present invention resides in the provision of novel, improved, segmented type nozzle rings and tip shoes for gas turbine engines.

Another important and primary object of the invention is the provision of gas turbine components as described in the preceding object which have improved sealing arrangements for keeping gases from leaking through the gaps between the adjacent segments of the components.

Yet other important but more specific objects of my invention reside in the provision of sealing arrangements in accord with the preceding object which employ a seal bridging and fitted at its edges into grooves opening onto the apposite faces of adjacent components and:

- which are capable of maintaining a tight seal even when the grooves are non-parallel or otherwise misaligned;
- which, in conjunction with the preceding object, are sufficiently flexible that they can readily warp or twist to the extent necessary to fit into misaligned grooves;
- which, in conjunction with the preceding objects, have a concave, gap-bridging portion for minimizing leak creating binding or distortion of the seal when it is fitted into misaligned grooves; and
- which, in conjunction with the preceding objects, have interference fits with the grooves into which they are fitted to keep gases from leaking through the grooves around the edges of the seal.

Other important objects and features and additional advantages of the invention will become apparent from the appended claims and as the ensuing detailed description and discussion proceeds in conjunction with the accompanying drawing, in which:

FIGS. 1A and 1B, taken together, constitute a partially sectioned side view of a gas turbine engine having segmented nozzles and tip shoes with the gaps between adjacent segments sealed in accord with the principles of the present invention;

FIG. 2 is a fragment of the foregoing view drawn to an enlarged scale to show more detail;

FIG. 2A is a fragment of FIG. 2 to an enlarged scale;

FIG. 2B is a section through FIG. 2A, taken substantially along line 2B—2B of the latter Figure;

FIG. 2C is a section through FIG. 2A, taken substantially along line 2C—2C of the latter Figure;

Figure 1A:
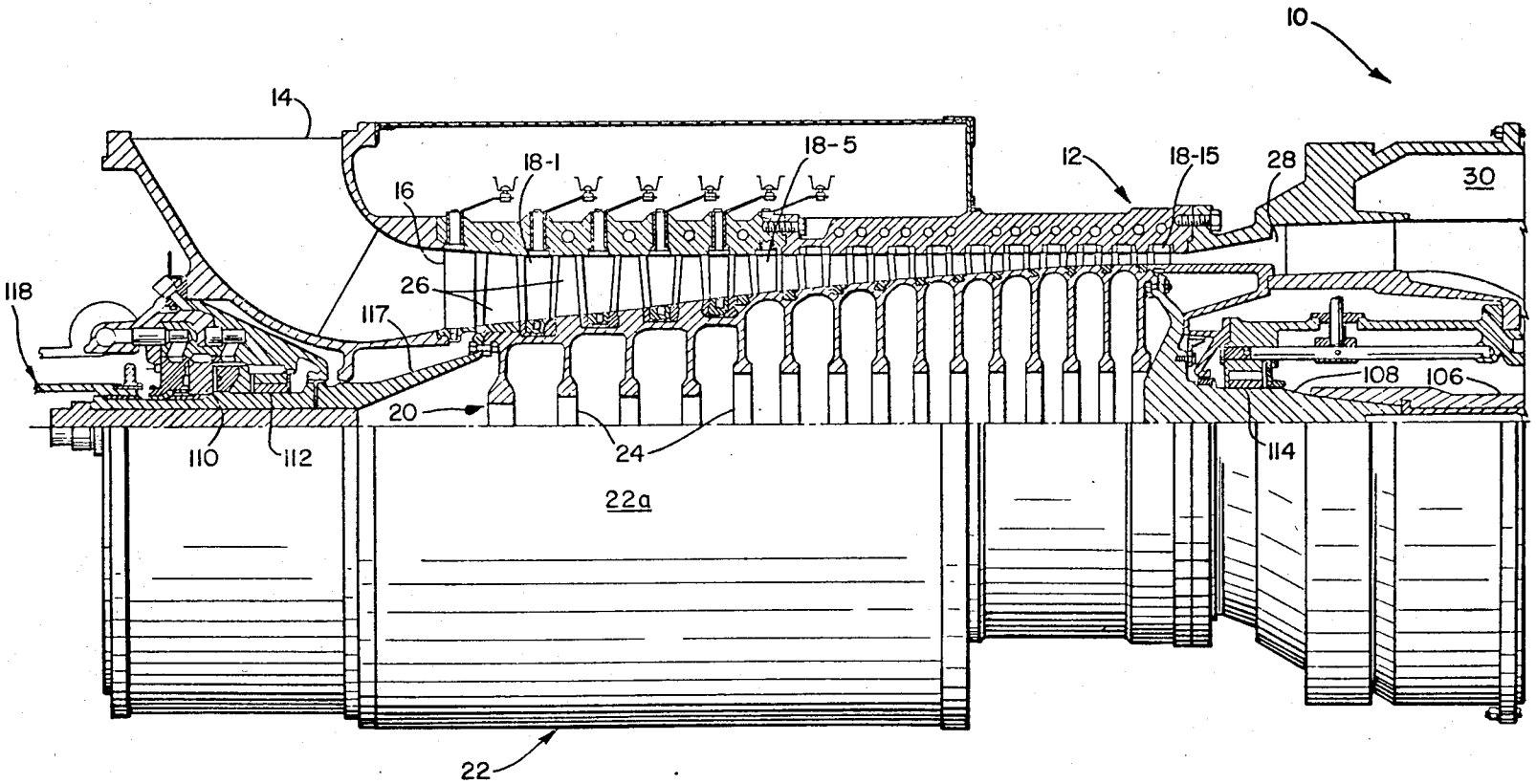
Figure 1B:
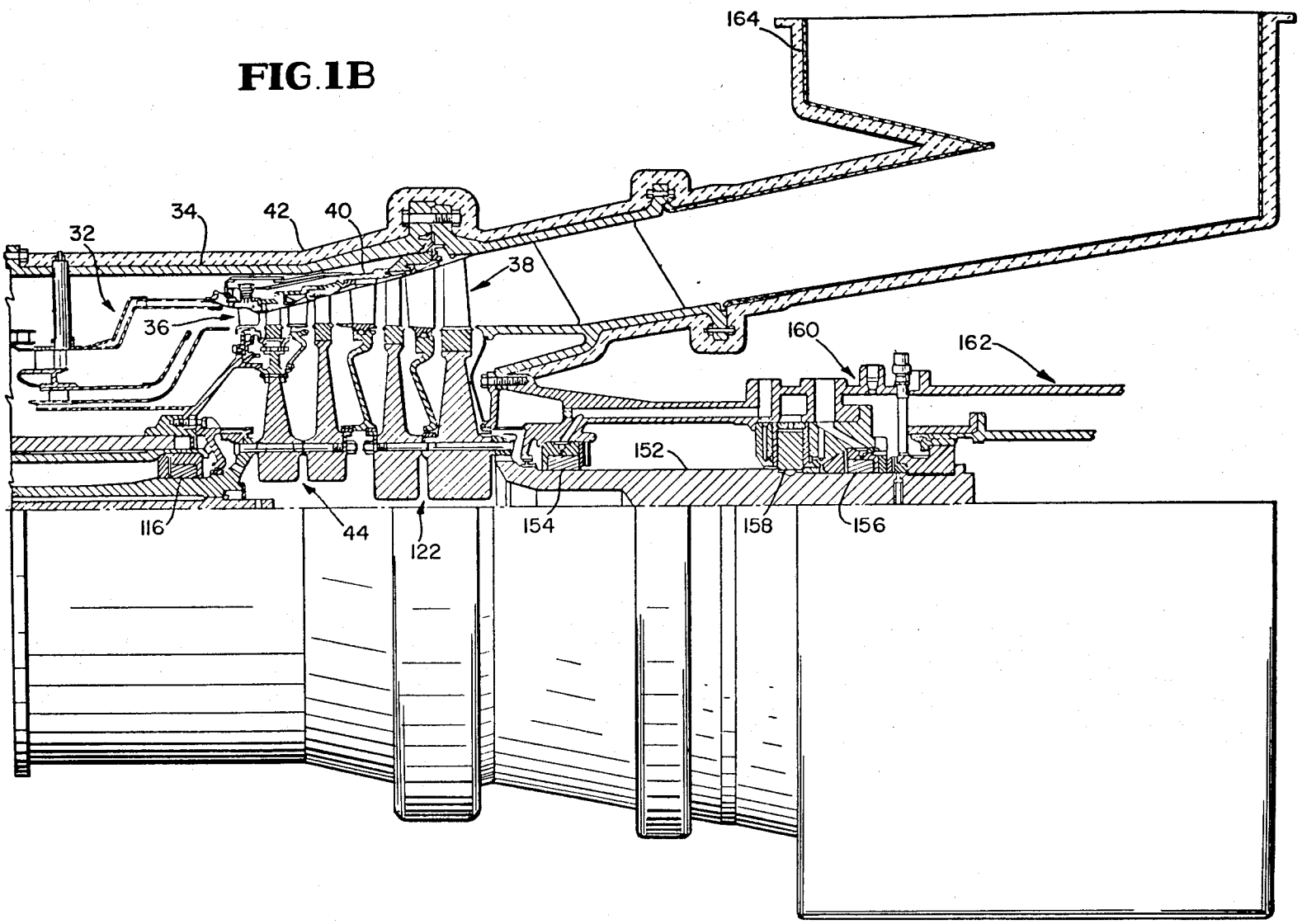

Referring now to the drawing, FIGS. 1A and 1B depict a two-shaft, gas turbine engine 10 which has segmented turbine nozzles and tip shoes with the gaps between adjacent segments sealed to keep gases from flowing therethrough in accord with the principles of the present invention.

Engine 10 includes a fifteen-stage axial flow compressor 12 with a radial-axial inlet 14, inlet guide vanes 16, stators 18, and a fifteen-stage rotor 20. The inlet guide vanes 16 and stators 18 are supported from the compressor housing 22 with the guide vanes and stators 18-1 through 18-5 of the first five stages being pivotally mounted so that they can be adjusted to control the flow of air through the compressor.

Each of the fifteen stages of the rotor 20 consists of a disc 24 with radially extending blades 26 fixed to the periphery of the disc. The stages are integrated into a unitary structure as by electron beam welding.

The compressor housing is split longitudinally along a vertical plane through the axial centerline of engine 10 into sections 22*a* (only one of which is shown) to accommodate assembly of the compressor and to facilitate inspection, cleaning, and replacement of guide vanes 16 and stators 18 and the blades 26 of compressor rotor 20.

The high pressure air discharged from compressor 12 flows through a diverging diffuser 28 and an enlarged dump plenum 30 to an annular combustor 32 supported in an insulated combustor case 34.

The compressor discharge air heated by combustor 32 and the combustion products generated in the combustor are expanded through a two-stage gas producer turbine 36 and then through a two-stage power turbine 38. The turbines are rotatably supported in a nozzle case 40 mounted in an annular turbine housing 42.

The gas producer turbine 36 has a two-stage rotor 44 and stationary, internally cooled, first and second stage nozzles 46 and 48.

The first stage nozzles are integral components of nozzle segments 50 each having two nozzles 46. The second stage nozzles are similarly integral components of nozzle segments 52 each having two second stage nozzles 48.

First stage nozzle segments 50 are assembled into an annular array or ring as are the second stage nozzle segments 52. Axially extending seals 54 constructed in accord with the principles of the present invention and briding the gaps between the juxtaposed outer shrouds 56 of adjacent segments 50 keep gases from escaping outwardly through the gaps between the nozzle segments. Longitudinally (or axially) oriented seals 58 bridging the gaps between the inner shrouds 60 of the nozzle segments (see FIGS. 2A and 2C) and radially extending seals 62 bridging the gaps between flanges 63 extending radially inward from shrouds 60 keep gases from leaking through the gaps between the inner ends of the nozzle segments.

Leakage of gases outwardly through the gaps between the second stage nozzle segments 52 is similarly prevented by longitudinally extending seals 64 between outer shrouds 66. Leakage inwardly through the gaps between the second stage nozzle segments is prevented by longitudinally extending seals 70 which bridge the gaps between the inner shrouds 74 of the second stage nozzle segments 52.

The first stage 76 of gas producer turbine rotor 44 includes a disc 78 to which internally cooled, radially extending blades 80 are fixed. An optical pyrometer 82 is sighted on blades 80 to measure their temperature.

The second stage 84 of the rotor includes a disc 86 with uncooled, radially extending blades 88 mounted on its periphery.

Figure 3:
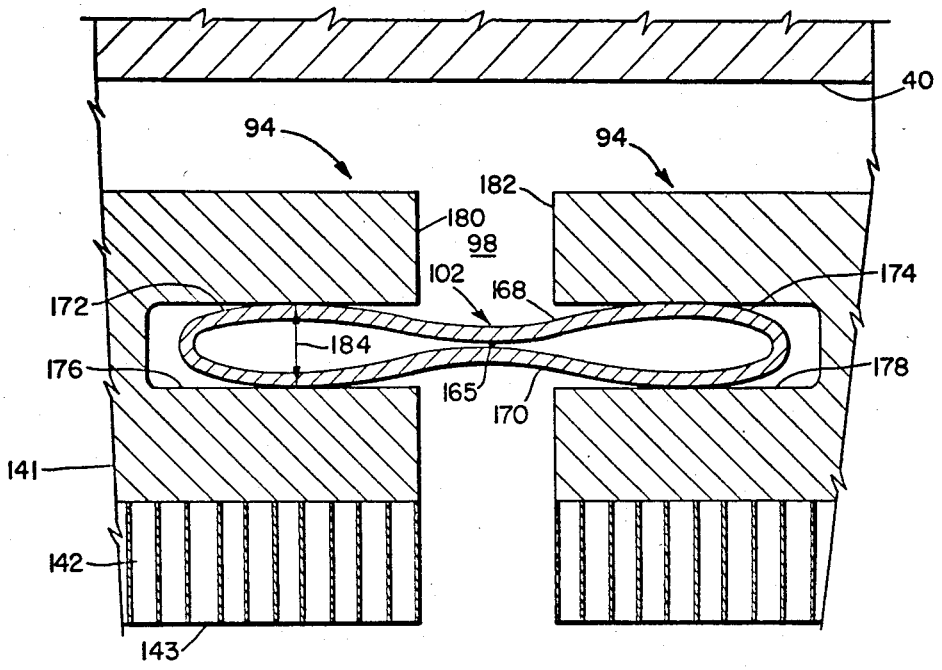
FIG. 3 is a fragmentary transverse cross-section taken substantially along line 3—3 of FIG. 2 to show one seal embodying and constructed in accord with the principles of the present invention.

The blades of the first and second stages 76 and 84 of gas producer turbine rotor 44 are surrounded by annular tip shoes 90 and 92 which are supported from nozzle case 40. Tip shoes 90 and 92 are respectively composed of segments 94 and 96 which have radially extending gaps therebetween (a typical gap between the segments 94 of tip shoe 90 is shown in FIG. 3 and identified by reference character 98. Longitudinally extending seals 102 and 104 of the character employed to keep gases from escaping through the gaps between first and second stage nozzle segments 50 and 52 bridge the gaps between first stage tip shoe segments 94 and second stage tip shoe segments 96 and keep gases from leaking through those gaps.

The two stages of the gas producer turbine rotor 44 are bolted to each other (see FIG. 2) and, in cantilever fashion, to the rear end of a forwardly extending shaft 106. shaft 106 is coupled through rear compressor hub 108 to comressor rotor 20, thereby drive-connecting gas producer turbine 36 to the compressor.

The compressor and gas producer turbine are rotatably supported by a thrust bearing 110 and by tilt pad bearings 112, 114, and 116. Bearings 110 and 112 engage the front compressor hub 117 which is bolted to rotor 20 and is drive-connected to an accessory drive through shaft 118.

Power turbine 38 includes first and second stage nozzles 119 and 120 also supported from nozzle case 40 and a rotor 122 having a first, bladed stage 124 and a second, bladed stage 126.

Like the nozzles of the gas producer turbine 36, the first stage nozzle 119 of power turbine 38 are integral components of nozzle segments 128. The segments are assembled into an annular array or ring and have radially extending gaps therebetween. Longitudinal seals 130 bridge the gaps between the outer shrouds 132 of adjacent segments 128 and keep gases from leaking through the gaps.

The second stage nozzles 120 of power turbine 38 are components of similarly assembled nozzle segments 134. Longitudinal seals 136 bridge and seal the gaps between the outer shrouds 138 of adjacent segments 134.

The blades of the first stage 124 of power turbine rotor 122 are surrounded by an annular tip shoe 140 which is supported from nozzle case 40.

Tip shoe 140, like those described previously, is of generally conventional construction. Each tip shoe includes a backing member 141 supported from nozzle case 40 and a member 142 of honeycomb or similarly compliant material bonded or otherwise fastened to the backing member. Each of the tip shoes has a working face 143 which is deformed by rotation of the associated blade tips therepast into an essentially zero tolerance fit with the tips, thereby keeping gases from leaking past the tips.

Tip shoe 140 is composed of segments 144 which have radially extending gaps therebetween.

Longitudinally extending seals 148 of the character employed to keep gases from escaping through the gaps between first and second stage nozzle segments 50 and 52 bridge the gaps between tip shoe segments 144 and keep gases from leaking through the gaps.

Power turbine rotor stages 124 and 126 are bolted together for concomitant rotation. Rotor 122 is bolted to a power turbine shaft assembly 152 rotatably supported by tilt pad bearings 154 and 156 and a thrust bearing 158. The shaft assembly is connected through a coupling 160 to an output shaft assembly 162 which furnishes the input for a generator, booster compressor, mechanical drive, or other driven unit (not shown).

The final major component of turbine engine 10 is an exhaust duct 164 for the gases discharged from power turbine 38.

For the most part, the details of the gas turbine engine components described above are not relevant to the present invention. Therefore, they will be described only as necessary to provide a setting for and facilitate an understanding of the latter.

Referring now specifically to FIG. 3 of the drawing, the seals 102 bridging the gaps 98 between adjacent segments 94 of the tip shoe in gas producer turbine 36 have a bow-shaped cross-section and are oriented with their longitudinal axes 165 extending in same direction as the axial centerline 166 of the turbine. Each of the strips 102 has two concave central or mid portions 168 and 170 disposed in mirror-image relationship and integral, looplike edge portions 172 and 174. The edge portions 172 and 174 of the strips fit into grooves 176 and 178 formed in the left-hand and right-hand segments 94 shown in FIG. 3. These grooves extend longitudinally of the segments and open on those apposite faces 180 and 182 of the segments bounding the gap 98 therebetween. The maximum width of the end portions of the strips, indicated by reference character 184 in FIG. 3, is selected so the end portions of the strips will have interference fits with the walls of the grooves in which they are disposed.

In one exemplary application of the present invention the gap 98 between the adjacent tip shoe segments 94 is 0.130 inches wide. The seals 102 developed for this application are made of 0.008 inch thick material and are fitted into grooves having a cross-sectional dimension 184 of 0.045 inch.

A seal of the configuration and dimensions just described and made of a heat resistant alloy such as Hastelloy X can readily twist or flex with respect to its longitudinal axis 165 to fit grooves such as those shown in FIG. 3 and discussed above even though the grooves may be non-parallel or otherwise misaligned. The concave mid-portions 168 and 170 of the seal keep the latter from binding and thereby distorting when it is installed in a misaligned groove. As discussed above, this is important because such distortion can result in leakage of gases past the seal.

Also, the interference fits between the edge portions 172 and 174 of the seal and the grooves 176 and 178 in tip shoe segment 94 is important because, again as discussed above, this helps to keep gases from leaking around the end portions of the seal through grooves 176 and 178. The seals 54 and 58 between the first stage gas producer turbine nozzle segments 50, the seals 64 and 70 between second stage gas producer turbine nozzle segments 52, the seals 104 between the segments 96 of gas producer turbine second stage tip shoe 92, the seals 130 and 136 between the first and second stage power turbine nozzle segments 128 and 134, and the seals 148 between the segments 144 of the first stage, power turbine tip shoe 140 may be of the same configuration and construction as seals 102 and may be assembled to and between the segments with which they are associated in essentially the same manner as the latter.

The seals 62 also bridging the gaps between adjacent first stage, gas producer nozzle segments 52 may again be of the same configuration and construction as seal 102. In this case, however, each seal is oriented with its axis of elongation extending in a radial direction and with its major cross-sectional axis oriented at a right angle rather than parallel to axial centerline 166 of the turbine engine. The seals are mounted in grooves 188 formed in the radially inwardly extending flanges 63 at the downstream sides of first stage nozzle segments 50 as is shown in FIGS. 2A and 2B; and they span the gaps between the flanges of adjacent segments.

Another seal in accord with the principles of the present invention which may be employed in place of any or all of those discussed above is illustrated in FIG. 4 and identified by reference character 190. Seal 190 has a concave central portion 192 bridging the gap 98 between adjacent tip shoe segments 94 and, again, looplike edge or side portions 194 and 196 dimensioned to provide interference fits with the inner and outer walls of the grooves 176 and 178 in the tip shoe segments.

Figure 4:
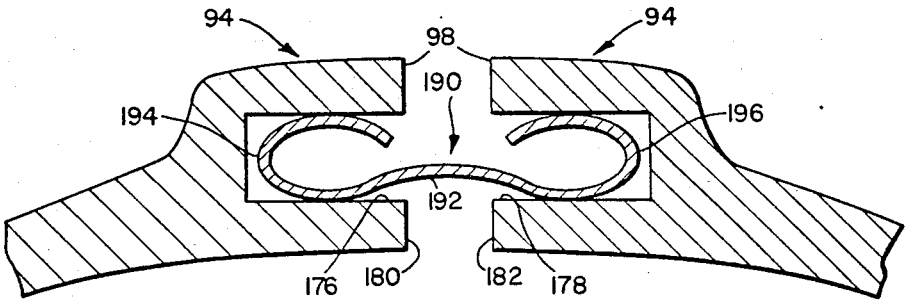
FIGS. 4 and 5 are views similar to FIG. 3 of alternate forms of seals employing the principles of my invention.
Figure 5:
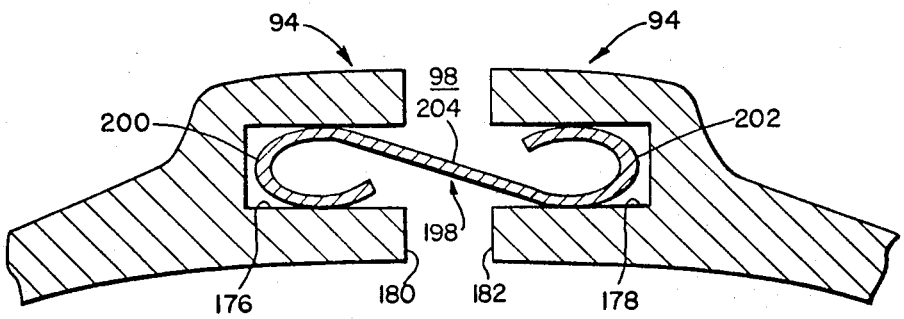

Yet another exemplary seal embodying the principles of the present invention is illustrated in FIG. 5 and identified by reference character 198. This seal has looplike edge portions 200 and 202 of the type illustrated in FIG. 4 except that, instead of both loops opening toward the outer side of tip shoe 90 as shown in FIG. 4, one loop (200) opens toward the inner side of the tip shoe. Edge portions 200 and 202 are connected by an integral central portion 204 which spans the gap 98 between the adjacent tip shoe segments 94. Although this connecting, mid portion of the seal is planar rather than concave as in the preceding embodiments of the invention, the advantages of the latter are nevertheless retained because of the interference fit of loops 200 and 202 with the inner and outer walls of grooves 176 and 178 and the ability of the seal to flex or twist with respect to its longtudinal center line and because the orientation of the two loops 200 and 202 permits the planar mid portion 204 of the seal to approximate the binding and distortion preventing action of the concave midsections of the previously described seals.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description; and all changes which come within the meaning and range of equivalency of the claims are therefore intended to be embraced therein.

What is claimed and desired to be secured by Letters Patent is:

1. A gas turbine comprising: a nozzle case through which heated gases are adapted to flow; a segmented, annular, stationary component in and supported from said nozzle case; and means for sealing the gaps between adjacent segments of said component to keep the heated gases from escaping through said gaps, said last-mentioned means comprising seals which are of monometallic, sheet metal construction and have a concave cross-section and arcuate edge portions, each said seal extending longitudinally with respect to, and sealing the gap between, two adjacent segments at both ambient and higher operating temperatures and each said seal being oriented with its major cross-sectional dimension orthoganally related to the axial centerline of the segmented component and to a radius extending from said centerline through the gap between said segments.

2. A gas turbine comprising: a nozzle case through which heated gases are adapted to flow; a segmented, annular, stationary component in and supported from said nozzle case; and means for sealing the gaps between adjacent segments of said component to keep the heated gases from escaping through said gaps, there being grooves opening onto the opposite faces of adjacent segments and said sealing means comprising seals which are of monometallic construction, said seals extending longitudinally with respect to, and bridging the gap between each two adjacent segments and said seals each having arced edge portions which are disposed in interference fits in and with the sides of said grooves both at ambient temperatures and at higher, operating temperatures.

3. A gas turbine comprising: a nozzle case through which heated gases are adapted to flow; a segmented, annular, stationary component in and supported from said nozzle case; and means for sealing the gaps between adjacent segments of said component to keep the heated gases from escaping through said gaps, there being grooves opening onto the apposite faces of adjacent segments and said sealing means comprising seals extending longitudinally with respect to, and sealing the gap between, each two adjacent segments at both ambient and higher, operating temperatures, said seals being of monometallic, sheet metal construction and those portions of the seals which bridge the gaps between adjacent segments of said stationary component having a concave cross-sectional configuration and arcuate edge portions.

4. A gas turbine comprising: a nozzle case through which heated gases are adapted to flow; a segmented, annulary, stationary component in and supported from said nozzle case; and means for sealing the gaps between adjacent segments to keep the heated gases from escaping through said gaps, there being grooves opening onto the apposite faces of adjacent segments of said component and said sealing means comprising seals extending longitudinally with respect to, and bridging the gap between, each two adjacent segments, said seals being of monometallic, sheet metal construction and each said seal having elastically deformable, arcuate edge portions which are elastically biased into interference fits with said grooves and provide a seal between said segments both at ambient temperatures and at higher, operating temperatures.

5. A gas turbine comprising: a nozzle case through which heated gases are adapted to flow; a segmented, annular, stationary component in and supported from said nozzle case; and means for sealing the gaps between adjacent segments of said component to keep the heated gases from escaping through said gaps, said last-mentioned means comprising seals with a concave cross-section, each said seal extending longitudinally with respect to, and bridging the gap between, two adjacent segments and each said seal having a continuous, periphery defining a closed curve and two concavely configured portions bridging the gap between the segments with which the seal is associated, said portions being in a mirror image relationship.

6. A gas turbine comprising: a nozzle case through which heated gases are adapted to flow; a segmented, annular, stationary component in and supported from said nozzle case; and means for sealing the gaps between adjacent segments to keep the heated gases from escaping through said gaps, there being grooves opening onto the apposite faces of adjacent segments and said sealing means comprising seals extending longitudinally with respect to, and bridging the gap between, each two adjacent segments, the edge portions of said seals being disposed in interference fits in said grooves and those edge portions of the seals disposed in interference fits with the segments bridged thereby having a loop-shaped cross-sectional configuration.

7. A gas turbine as defined in claim 6 wherein one of said loop-shaped edge portions of each seal opens toward the exterior of the nozzle case, the other of said edge portions opens toward the interior of the nozzle case, and said edge portions are connected by a planar central portion which bridges the gap between the segments in which the edge portion of the seal are fitted.

8. A gas turbine as defined in claim 6 wherein both of said loop-shaped edge portions of each seal open toward the exterior of the nozzle case and said edge portions are connected by a planar central portion which bridges the gap between the segments in which the edge portions of the seal are fitted.

9. A gas turbine comprising: a nozzle case through which heated gases are adapted to flow; flow directing nozzles integrated into nozzle segments arranged in an annular array, said segments being supported in juxtaposed relationship from said case; and means for sealing the gaps between adjacent segments to keep the heated gases from escaping through said gaps, said last-mentioned means comprising seals which are of monometallic, sheet metal construction and have a concave cross-section and arcuate edge portions, each said seal extending longituidnally with respect to, and sealing the gap between, two adjacent segments at both ambient and higher, operating temperatures and each said seal being oriented with its major cross-sectional dimension orthoganally related to the axial centerline of the nozzle case and to a radius extending from said centerline through the gap between said segments.

10. A gas turbine comprising: a nozzle case through which heated gases are adapted to flow; flow directing nozzles integrated into nozzle segments arranged in an annular array, said segments being supported in juxtaposed relationship from said case; and means for sealing the gaps between adjacent nozzle segments to keep the heated gases from escaping through said gaps, there being grooves opening onto the apposite faces of adjacent segments and said sealing means comprising seals which are of monometallic construction, said seals extending longitudinally with respect to, and bridging the gap between, each two adjacent segments and said seals each having arced edge portions which are disposed in interference fits in and with the sides of said grooves both at ambient temperatures and at higher, operating temperatures.

11. A gas turbine comprising: a nozzle case through which heated gases are adapted to flow; flow directing nozzles integrated into nozzle segments arranged in an annular array, said segments being supported in juxtaposed relationship from said case; and means for sealing the gaps between adjacent segments to keep the heated gases from escaping through said gaps, there being grooves opening onto the apposite faces of adjacent segments and said sealing means comprising seals extending longitudinally with respect to, and sealing the gap between, each two adjacent segments at both ambient and higher, operating temperatures, said seals being of monometallic, sheet metal construction and those portions of the seals which bridge the gaps between adjacent segments of said nozzle case having a concave cross-sectional configuration and arcuate edge portions.

12. A gas turbine comprising: a nozzle case through which heated gases are adapted to flow; flow directing nozzles integrated into nozzle segments arranged in an annular array, said segments being supported in juxtaposed relationship from said case; and means for sealing the gaps between adjacent segments to keep the heated gases from escaping through said gaps, said sealing means comprising seals extending longitudinally with respect to, and bridging the gap between, each two adjacent segments, there being grooves opening onto the apposite faces of adjacent segments and said seals being of monometallic, sheet metal construction and each said seal having elastically deformable, arcuate edge portions which are elastically biased into interference fits with said grooves and thereby provide a seal between said segments both at ambient temperatures and at higher, operating temperatures.

13. A gas turbine comprising: a nozzle case through which heated gases are adapted to flow; an annular array of radially extending flow directing nozzles supported from said case; a bladed rotor; means supporting said rotor in said case downstream from said nozzles for rotation about an axis extending longitudinally of the case; an annular array of tip shoe segments surrounding said rotor; and means for sealing the gaps between adjacent tip shoe segments to keep the heated gases from escaping through said gaps, said last-mentioned means comprising seals which are of monometallic, sheet metal construction and have a concave cross-section and arcuate edge portions, each said seal extending longitudinally with respect to, and sealing the gap between, two adjacent segments at both ambient and higher, operating temperatures and each said seal being oriented with its major cross-sectional dimension orthoganally related to the axial centerline if the tip shoe array and to a radius extending from said centerline through the gap between said segments.

14. A gas turbine comprising: a nozzle case through which heated gases are adapted to flow; an annular array of radially extending flow directing nozzles supported from said case; a bladed rotor; means supporting said rotor in said case downstream from said nozzles for rotation about an axis extending longitudinally of the case; an annular array of tip shoe segments surrounding said rotor; and means for sealing the gaps between adjacent tip shoe segments to keep the heated gases from escaping through said gaps, there being grooves opening onto the apposite faces of adjacent tip shoe segments and said sealing means comprising seals which are of monometallic construction, said seals extending longitudinally with respect to, and bridging the gap between, each two adjacent segments and said seals each having arced edge portion which are disposed in interference fits in and with the sides of said grooves both at ambient temperatures and at higher, operating temperatures.

15. A gas turbine comprising: a nozzle case through which heated gases are adapted to flow; an annular array of radially extending flow directing nozzles supported from said case; a bladed rotor; means supporting said rotor in said case downstream from said nozzles for rotation about an axis extending longitudinally of the case; an annular array of tip shoe segments surrounding said rotor; and means for sealing the gaps between adjacent tip shoe segments to keep the heated gases from escaping through said gaps, said sealing means comprising seals extending longitudinally with respect to, and sealing the gap between, each two adjacent segments at both ambient and higher, operating temperatures, said seals being of monometallic, sheet metal construction and those portions of the seals which bridge the gaps between adjacent tip shoe segments having a concave cross-sectional configuration and arcuate edge portions.

16. A gas turbine comprising: a nozzle case through which heated gases are adapted to flow; an annular array of radially extending flow directing nozzles supported from said case; a bladed rotor; means supporting said rotor in said case downstream from said nozzles for rotation about an axis extending longitudinally of the case; an annular array of tip shoe segments surrounding said rotor; and means for sealing the gaps between the adjacent tip shoe segments to keep the heated gases from escaping through said gaps, there being grooves opening onto the apposite faces of adjacent tip shoe segments and said sealing means comprising seals extending longitudinally with respect to, and bridging the gap between, each two adjacent segments, said seals being of monometallic, sheet metal construction and each said seal having elastically deformable, arcuate edge portions which are elastically biased into interference fits with said grooves and provide a seal between said segments both at ambient temperatures and at higher, operating temperatures.

17. A gas turbine engine comprising: a compressor; a combustor for heating air discharged from said compressor; a gas producer turbine drive-connected to said compressor through which the heated air and combustion products generated in said compressor can expand to drive the gas producer turbine and the compressor; and a power turbine downstream from said gas producer turbine, said gas producer turbine being a turbine as defined in any of the preceding claims 2, 5, 6, 7, 8, 10 or 14.

18. A gas turbine engine comprising: a compressor; a combustor for heating air discharged from said compressor; a gas producer turbine drive-connected to said compressor through which the heated air and combustion products generated in said compressor can expand to drive the gas producer turbine and the compressor; and a power turbine downstream from the gas producer turbine, said gas producer turbine being a turbine as defined in any of the preceding claims 1, 3, 4, 9, 11-13, 15 or 16.

* * * * *

UNITED STATES PATENT AND TRADEMARK OFFICE

CERTIFICATE OF CORRECTION

PATENT NO. : 4,537,024

DATED : August 27, 1985

INVENTOR(S) : William C. Grosjean

It is certified that error appears in the above-identified patent and that said Letters Patent are hereby corrected as shown below:

In the Abstract, line 4, "opposite" should be --apposite--.

Column 2, line 19, after "grooves" insert --may--.

Column 4, line 26, after "98" insert a --close parenthesis--.

Column 4, line 36, "shaft" should be --Shaft--.

Column 5, line 32, after "tip shoe" insert --90--.

Column 7, line 23, "opposite" should be --apposite--.

Column 8, line 31, "portion" should be --portions--.

Column 9, line 53, "if" should be --of--.

Signed and Sealed this

*Fifteenth* Day of *July 1986*

[SEAL]

*Attest:*

DONALD J. QUIGG

*Attesting Officer*

*Commissioner of Patents and Trademarks*